US008646757B1

(12) United States Patent
McGrew, Jr.

(10) Patent No.: US 8,646,757 B1
(45) Date of Patent: Feb. 11, 2014

(54) SUBMERSIBLE AERATION PUMP

(76) Inventor: Henry E. McGrew, Jr., Benton, LA (US)

( * ) Notice: Subject to any disclaimer, the term of this patent is extended or adjusted under 35 U.S.C. 154(b) by 380 days.

(21) Appl. No.: 13/135,625

(22) Filed: Jul. 11, 2011

Related U.S. Application Data

(60) Provisional application No. 61/459,776, filed on Dec. 20, 2010.

(51) Int. Cl.
*B01F 3/04* (2006.01)

(52) U.S. Cl.
USPC ..... 261/83; 261/87; 261/121.1; 261/124; 210/220

(58) Field of Classification Search
USPC ..... 261/83, 87, 119.1, 121.1, 124; 210/220
See application file for complete search history.

(56) References Cited

U.S. PATENT DOCUMENTS 2,410,973 A 11/1946 Hoover
3,220,350 A 11/1965 White
3,393,641 A 7/1968 Meidaner et al.
3,911,064 A * 10/1975 McWhirter et al. ..... 261/87
4,134,711 A 1/1979 Ivins et al.
4,181,475 A 1/1980 Stahl
4,201,524 A 5/1980 Wilkins
4,225,292 A 9/1980 Hallerback et al.
4,488,852 A 12/1984 Ivins et al.
4,632,643 A 12/1986 Nielsen
5,352,357 A 10/1994 Perry
5,549,818 A 8/1996 McGrew, Jr.
7,341,436 B2 3/2008 Andrews

* cited by examiner

*Primary Examiner* — Robert A Hopkins
(74) *Attorney, Agent, or Firm* — R. Keith Harrison

(57) ABSTRACT

A submersible aeration pump includes a motor housing, an air inlet conduit carried by the motor housing, a pump motor in the motor housing, a rotatable armature drivingly engaged by the pump motor and disposed in air communication with the air inlet conduit and at least one air discharge conduit carried by and disposed in air communication with the armature. Air is drawn from the air inlet conduit, through at least a portion of the armature and is discharged from the at least one air discharge conduit, respectively, by centrifugal force responsive to operation of the pump motor.

22 Claims, 8 Drawing Sheets

SUBMERSIBLE AERATION PUMP

CROSS-REFERENCE TO RELATED APPLICATIONS

This application claims the benefit of and incorporates by reference in its entirety U.S. Provisional application No. 61/459,776, filed Dec. 20, 2010 and entitled "SUBMERSIBLE AERATION PUMP".

FIELD

The disclosure generally relates to apparatuses for aerating liquid media. More particularly, the disclosure relates to a submersible aeration pump which disperses air into a liquid medium via centrifugal force.

BACKGROUND

Aeration of liquid media is desirable in a variety of applications. Water aeration may be required in water bodies that suffer from anoxic conditions caused by various human activities. Natural water bodies such as lakes, lagoons or ponds may be aerated through the infusion of air into the bottom of the water body or by surface agitation using a fountain or other spray-like device. One goal of water aeration in such applications may be to increase the oxygen content of the water and enhance water quality, enhancing the life of fish and other aquatic life.

In some applications, it may be desirable to treat sewage by aeration of wastewater in a sewage treatment tank. A sewage treatment tank of a conventional sewage treatment system may include a cylindrical outer mixing tank and an inverted funnel-shaped clarifier inside the mixing tank. Raw, unsettled wastewater and solid waste from a residence or business initially enters an aeration chamber in the outer mixing tank, where simple hydraulic displacement is accomplished by introduction of air that promotes growth of aerobic organisms in much larger colonies than would occur naturally in the aeration chamber. The aerobic organisms also break down organic solids in the wastewater, producing inorganic and stable organic solids. Ultimately, the aerated wastewater may be of sufficient quality that the wastewater can be discharged to a lake, river, pond or other natural water body.

A submersible aeration pump which disperses air into a liquid medium via centrifugal force and is amenable to wastewater treatment and other applications is needed.

SUMMARY

The disclosure is generally directed to a submersible aeration pump which disperses air into a liquid medium via centrifugal force and is amenable to wastewater treatment and other applications. An illustrative embodiment of the submersible aeration pump includes a motor housing, an air inlet conduit carried by the motor housing, a pump motor in the motor housing, a rotatable armature drivingly engaged by the pump motor and disposed in air communication with the air inlet conduit and at least one air discharge conduit carried by and disposed in air communication with the armature. Air is drawn from the air inlet conduit, through at least a portion of the armature and is discharged from the at least one air discharge conduit, respectively, by centrifugal force responsive to operation of the pump motor.

In some embodiments, the submersible aeration pump may include an air inlet conduit; a motor housing disposed in air communication with the air inlet conduit; a pump motor in the motor housing; a rotatable armature drivingly engaged by the pump motor and having an armature cavity disposed in air communication with the motor housing; and at least one air discharge conduit carried by and disposed in air communication with the armature cavity of the armature. Air is drawn from the air inlet conduit, through the motor housing and the armature cavity of the armature and is discharged from the at least one air discharge conduit, respectively, by centrifugal force responsive to operation of the pump motor.

In some embodiments, the submersible aeration pump may include a motor housing; an air inlet conduit carried by the motor housing; a pump motor in the motor housing; a rotatable armature drivingly engaged by the pump motor and having an armature bore disposed in air communication with the air inlet conduit; and at least one air discharge conduit carried by and disposed in air communication with the armature bore of the armature. Air is drawn from the air inlet conduit, through the armature bore of the armature and is discharged from the at least one air discharge conduit, respectively, by centrifugal force responsive to operation of the pump motor.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. Relative terms such as "upper" and "lower" herein are used with reference to relative positions of various elements with respect to each other in exemplary application of the submersible aeration pump and are not intended to be used in a limiting sense.

Figure 3:
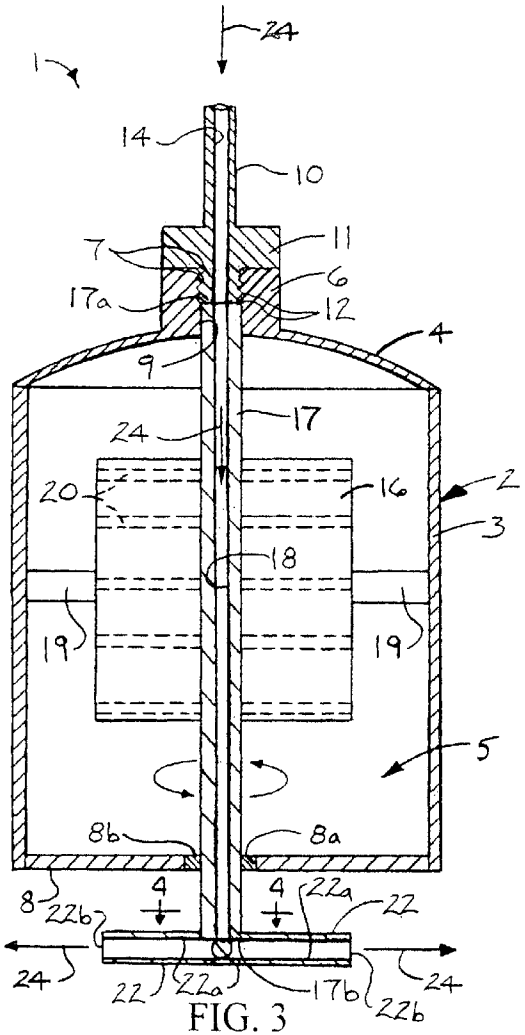
FIG. 3 is a longitudinal sectional view of an illustrative embodiment of the submersible aeration pump.
Figure 7:
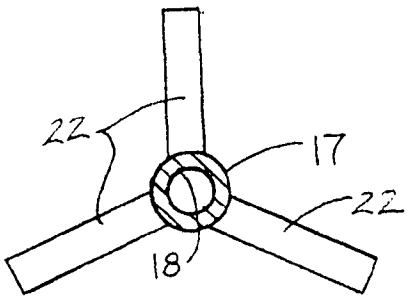
FIG. 7 is a sectional view of an armature of the submersible aeration pump, more particularly illustrating three air discharge conduits according to some embodiments of the submersible aeration pump.
Figure 9:
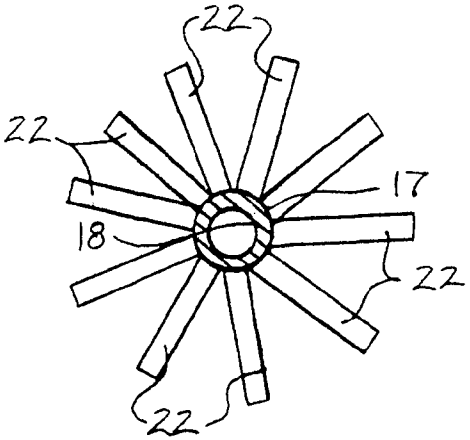
FIG. 9 is a sectional view of an armature of the submersible aeration pump, more particularly illustrating ten air discharge conduits according to some embodiments of the submersible aeration pump.
Figure 6:
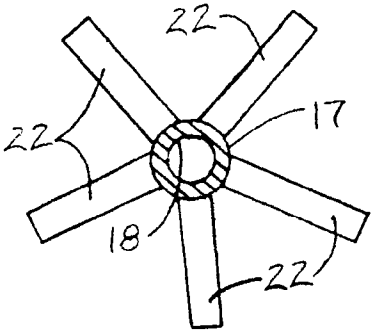
FIG. 6 is a sectional view of an armature of the submersible aeration pump, more particularly illustrating five air discharge conduits according to some embodiments of the submersible aeration pump.
Figure 8:
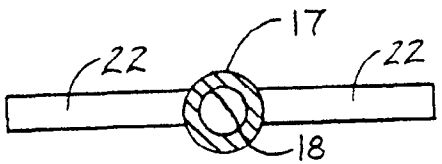
FIG. 8 is a sectional view of an armature of the submersible aeration pump, more particularly illustrating two air discharge conduits according to some embodiments of the submersible aeration pump.
Figure 5:
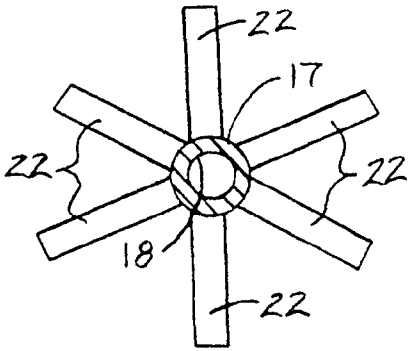
FIG. 5 is a sectional view, such as that taken along section lines 2-2 in FIG. 1, of an armature of the submersible aeration pump, more particularly illustrating six air discharge conduits according to some embodiments of the submersible aeration pump.

Referring initially to FIGS. 1-9 of the drawings, an illustrative embodiment of the submersible aeration pump, hereinafter pump, is generally indicated by reference numeral 1. The pump 1 may include a motor housing 2 which may have a generally cylindrical or alternatively-shaped motor housing wall 3 with a motor housing interior 5 (FIG. 3). A motor housing top 4 may be provided on the motor housing wall 3 to close the upper end of the motor housing interior 5. In some embodiments, the motor housing top 4 may have a generally dome shape, as illustrated. The motor housing 2 may have a housing bottom 8 which closes the lower end of the motor housing interior 5, as illustrated in FIG. 3. A seal opening 8*a* may be provided in the housing bottom 8. A seal 8*b* may be provided in the seal opening 8*a* for purposes which will be hereinafter described.

An air inlet conduit 10 having an air conduit bore 14 (FIG. 3) may be adapted for attachment to the motor housing 2 for purposes which will be hereinafter described. In some embodiments, a motor housing neck 6 may extend from the motor housing top 4 of the motor housing 2. The motor housing neck 6 may have an interior motor housing neck bore 9. Interior neck threads 7 may extend into an upper portion of the motor housing neck bore 9 of the motor housing neck 6. A male conduit adaptor 11 may terminate the end of the air inlet conduit 10. The male conduit adaptor 11 may have exterior adaptor threads 12 which engage the interior neck threads 7 in the motor housing neck bore 9 of the motor housing neck 6, as illustrated in FIG. 3. Alternative techniques known by those skilled in the art may be used to attach the air inlet conduit 10 to the motor housing 2. In some embodiments, the air inlet conduit 10 may be fabricated in one piece with or fixedly attached to the motor housing 2 using molding, casting, glueing or other fabrication techniques known by those skilled in the art.

An armature 17 may have an armature bore 18 which is disposed in air communication with the air conduit bore 14 of the air inlet conduit 10. The armature 17 may be generally elongated and cylindrical with an upper armature end 17*a* and a lower armature end 17*b* opposite the upper armature end 17*a*. The upper armature end 17*a* of the armature 17 may be inserted in the non-threaded lower portion of the motor housing neck bore 9 of the motor housing neck 6. The upper armature end 17*a* of the armature 17 may be rotatable with respect to the interior surfaces of the motor housing neck bore 9. Accordingly, in some embodiments, at least one bearing (not illustrated) may be seated in the motor housing neck bore 9. The upper armature end 17*a* may extend through the bearing, which facilitates free rotation of the armature 17 with respect to the motor housing neck 6.

Figure 2:
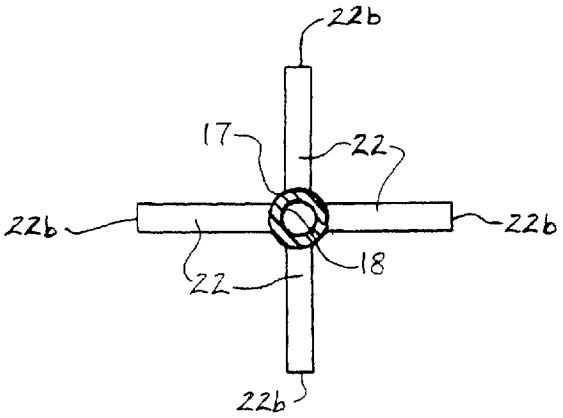
FIG. 2 is a sectional view, taken along section lines 2-2 in FIG. 1, of an armature of the submersible aeration pump, more particularly illustrating four air discharge conduits according to some embodiments of the submersible aeration pump.
Figure 2A:
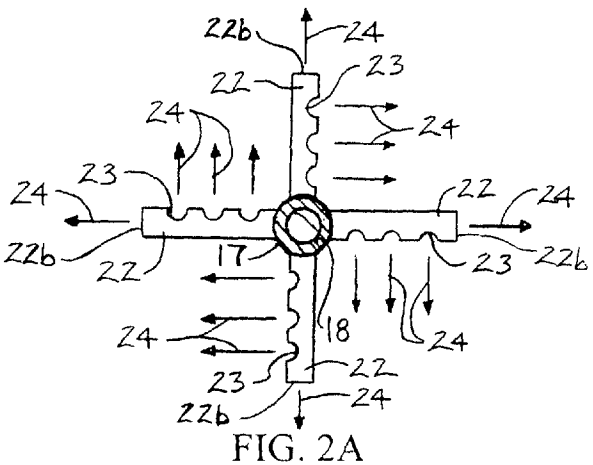
FIG. 2A illustrates air discharge conduits each having multiple air discharge openings according to some embodiments of the submersible aeration pump.
Figure 1:
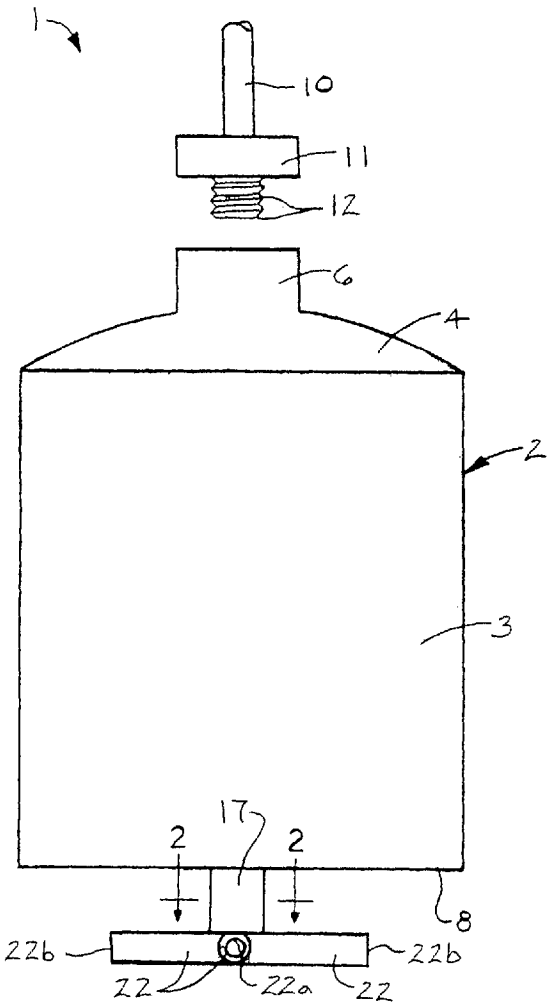
FIG. 1 is a partially-exploded side view of an illustrative embodiment of the submersible aeration pump.

The lower armature end 17*b* of the armature 17 may protrude from the motor housing interior 5 through the seal 8*b* in the housing bottom 8, as illustrated in FIG. 3. The seal 8*b* may impart a substantially fluid-tight seal with the armature 17. At least one air discharge conduit 22 may extend outwardly from the lower armature end 17*b* of the armature 17 or, in other embodiments, from the armature 17 between the upper armature end 17*a* and the lower armature end 17*b*. Each air discharge conduit 22 may be fixed with respect to the armature 17. Each air discharge conduit 22 may have a discharge conduit bore 22*a* (FIGS. 3 and 4) which is disposed in air communication with the armature bore 18 of the armature 17 and a terminal discharge opening 22*b* which is distal to the armature 17. The air discharge conduits 22 may be oriented in generally perpendicular relationship with respect to the longitudinal axis of the armature 17 and in generally coplanar relationship with respect to each other. In some embodiments, the air discharge conduits 22 may be external to the motor housing 2, as illustrated in FIGS. 1 and 3. As illustrated in FIG. 2A, in some embodiments, at least one intermediate air discharge opening 23 may be provided in each air discharge conduit 22 between the armature 17 and the extending or distal terminal discharge opening 22*b* of the air discharge conduit 22.

As illustrated in FIGS. 5-9, it will be appreciated by those skilled in the art that any desired number of air discharge conduits 22 may extend outwardly from the armature 17. For example and without limitation, in the illustrative embodiment of FIG. 5, six air discharge conduits 22 extend outwardly from the armature 17 in spaced-apart relationship to each other; in the illustrative embodiment of FIG. 6, five air discharge conduits 22 extend outwardly from the armature 17; and in the illustrative embodiment of FIG. 7, three air discharge conduits 22 extend from the armature 17. In other embodiments, as few as two (FIG. 8) and as many as ten (FIG. 9) or more air discharge conduits 22 may extend from the armature 17.

As further illustrated in FIG. 3, a pump motor 16 may be provided in the motor housing interior 5 of the motor housing 2. The pump motor 16 may be an electric motor of conventional design and having motor windings 20. In some embodiments, motor supports 19 of selected design may support the pump motor 16 in the motor housing interior 5. The pump motor 16 drivingly engages the armature 17 for rotation of the armature 17 inside the motor housing interior 5 of the motor housing 2. The armature 17 is adapted to rotate the air discharge conduits 22 which may be fixed at the lower armature end 17*b* or, in alternative embodiments, between the upper armature end 17*a* and the lower armature end 17*b* of the armature 17 for purposes which will be hereinafter described.

Figure 12:
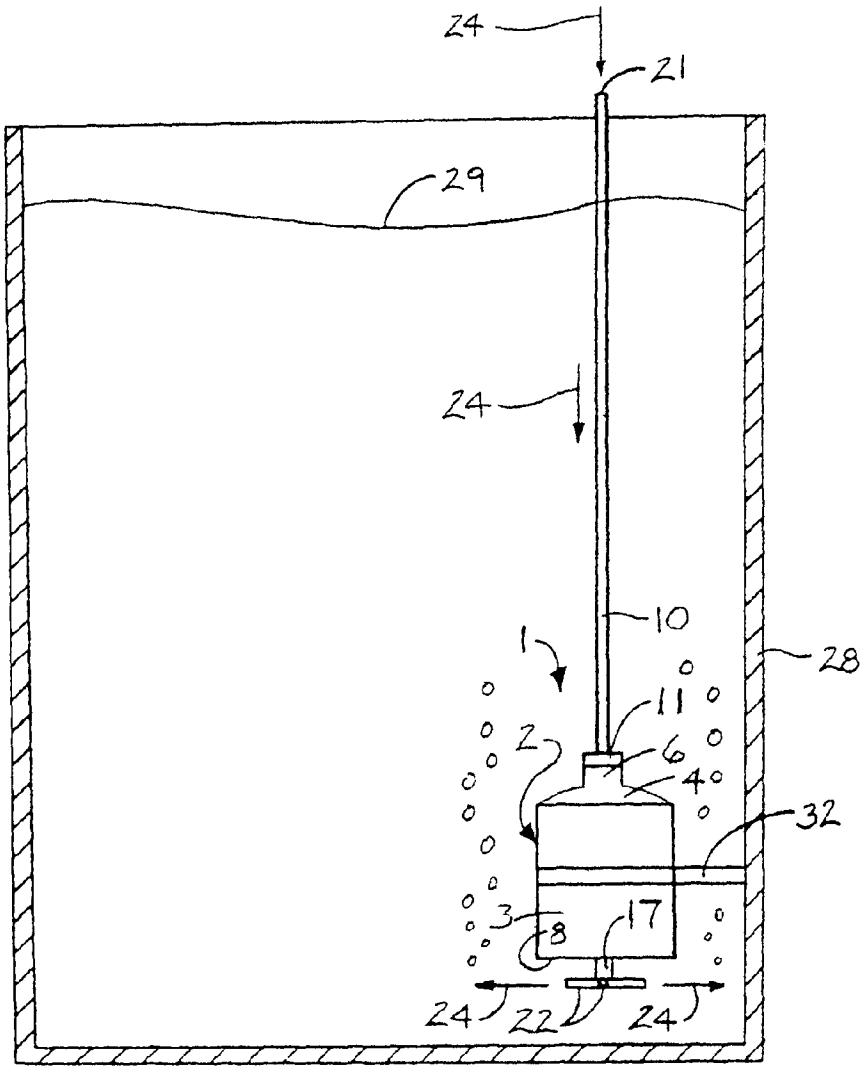
FIG. 12 is a sectional view of a tank containing a liquid medium, with an illustrative embodiment of the submersible aeration pump such as that illustrated in FIGS. 1-4 submerged in the liquid medium and air dispersed into the liquid medium by operation of the submersible aeration pump.

Referring next to FIG. 12 of the drawings, in exemplary application, the pump 1 is submerged in a liquid medium 29 which is contained in a suitable tank 28 to aerate the liquid medium 29. In some applications, the tank 28 may be a sewage treatment tank and the liquid medium 29 may be wastewater which is to be treated in the sewage treatment tank. Accordingly, the pump 1 is operated to aerate the wastewater in the tank 28 as part of treatment of the wastewater. The pump 1 may be secured in the tank 28 using a selected support bracket 32 which is suitable for the purpose. An inlet end 21 of the air inlet conduit 10 may protrude beyond the surface of the liquid medium 29.

Figure 4:
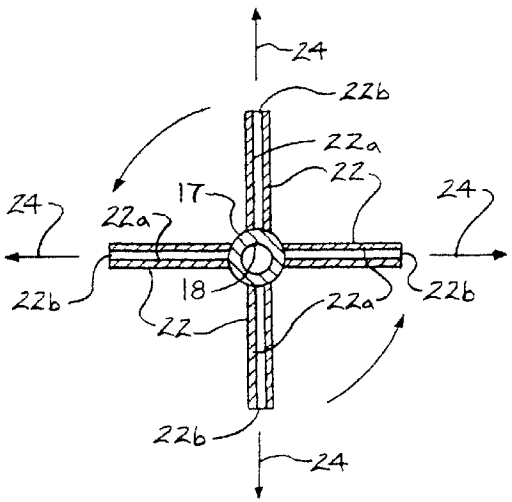
FIG. 4 is a sectional view, taken along section lines 4-4 in FIG. 3, of an armature according to some embodiments of the submersible aeration pump, more particularly illustrating four air discharge conduits in section.

In operation of the pump 1, the pump motor 16 (FIG. 3) rotates the armature 17 in the motor housing interior 5 of the motor housing 2. In turn, the armature 17 rotates the air discharge conduits 22 in a circular path at or above the lower armature end 17*b* of the armature 17, as illustrated in FIG. 4. Centrifugal force which is generated by the rotating motion of the air discharge conduits 22 pulls air 24 from the discharge conduit bores 22*a* of the respective air discharge conduits 22 into the surrounding liquid medium 29 in the tank 28 through the terminal discharge openings 22*b* of the respective discharge conduits 22. The drop in air pressure which results in the discharge conduit bores 22*a* of the discharge conduits 22 draws air 24 from the armature bore 18 of the armature 17 into the discharge conduit bores 22*a* of the air discharge conduits 22 and ambient air 24 into the armature bore 18 of the armature 17 through the inlet end 21 of the air inlet conduit 10. The centrifugal force also disperses the air 24 which is discharged from the air discharge conduits 22 outwardly into the liquid medium 29, away from the apparatus 1. Accordingly, the discharged air 24 aerates and increases the oxygen content of the liquid medium 29 and the circular and outward dispersal path of the air 24 into the liquid medium 29 results in a substantially uniform distribution of the oxygen in the liquid medium 29. In applications in which the tank 28 is a sewage treatment tank and the liquid medium 29 is wastewater, the air 24 may additionally facilitate mixing of the wastewater as well as promote growth of aerobic organisms which break down organic solids in the wastewater. As illustrated in FIG. 2A, in some embodiments, a portion of the air 24 (FIG. 4) may be discharged from each air discharge conduit 22 through one or more of the intermediate air discharge openings 23 which may be provided in one or more of the air discharge conduits 22 between the armature 17 and the terminal discharge opening 22*b* of the air discharge conduit 22.

Figure 11:
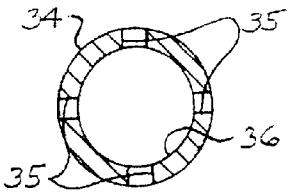
FIG. 11 is a sectional view, taken along section lines 11-11 in FIG. 10, of an armature of the submersible aeration pump with multiple armature openings in the armature according to some embodiments of the submersible aeration pump.
Figure 10:
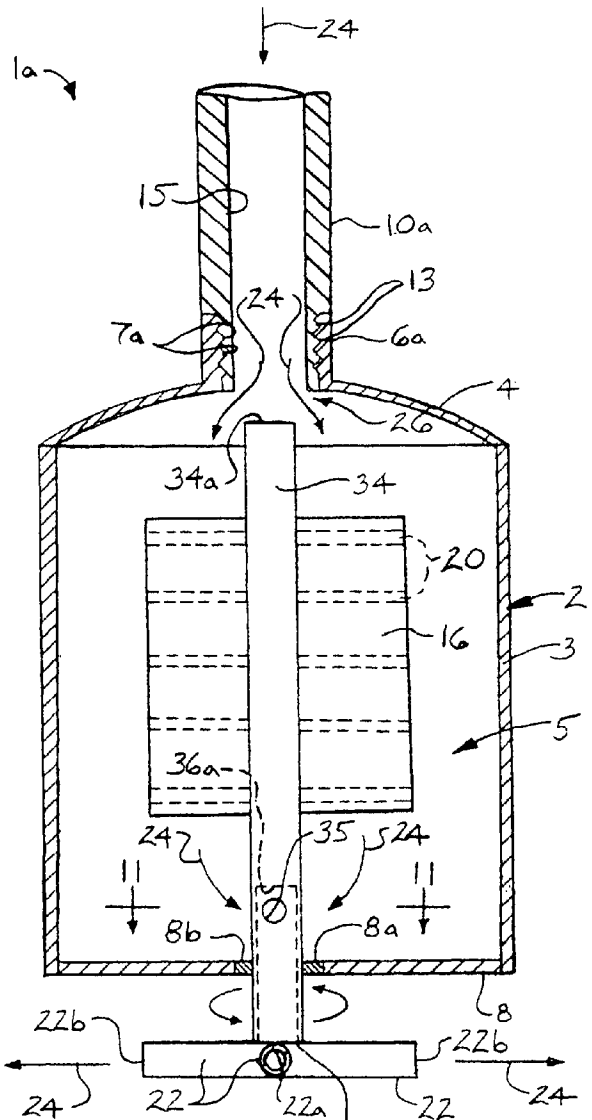
FIG. 10 is a longitudinal sectional view of an alternative illustrative embodiment of the submersible aeration pump.

Referring next to FIGS. 10 and 11 of the drawings, an alternative illustrative embodiment of the submersible aeration pump is generally indicated by reference numeral 1*a*. An air inlet conduit 10*a* having an air conduit bore 15 may be disposed in air communication with the motor housing interior 5 of the motor housing 2. A motor housing neck 6*a* having interior motor housing neck threads 7*a* may extend from the motor housing top 4 of the motor housing 2. The air inlet conduit 10*a* may have exterior air conduit threads 13 which engage the interior motor housing neck threads 7*a* of the motor housing neck 6*a*. An armature 34 has an upper armature end 34*a* and a lower armature end 34*b* which is opposite the upper armature end 34*a*. The upper armature end 34*a* may be positioned beneath the motor housing neck 6*a* of the motor housing 2. An air flow space 26 may be defined in the motor housing interior 5 between the motor housing neck 6*a* and the upper armature end 34*a* of the armature 34.

An armature cavity 36*a* (illustrated in phantom) may be provided in the lower end portion of the armature 34. At least one armature opening 35 in the armature 34 may establish air communication between the motor housing interior 5 and the armature cavity 36*a*. As illustrated in FIG. 11, in some embodiments multiple armature openings 35 in the armature 34 may communicate with the armature cavity 36*a*. The armature openings 35 may be spaced-apart with respect to each other around the circumference of the armature 34. At least one air discharge conduit 22 having a discharge conduit bore 22*a* may extend generally from the lower armature end 34*b* of the armature 34 or from the armature 34 between the upper armature end 34*a* and the lower armature end 34*b*. As was heretofore described with respect to FIGS. 5-9, any desired number of air discharge conduits 22 may extend from the armature 34 in various embodiments of the pump 1*a*. In some embodiments, at least one intermediate air discharge opening 23 (FIG. 2A) may be provided in each air discharge conduit 22 between the armature 34 and the terminal discharge opening 22*b* of the air discharge conduit 22.

Application of the pump 1*a* may be as was heretofore described in FIG. 12 with respect to the pump 1 in FIG. 1. Accordingly, the pump motor 16 of the pump 1*a* rotates the armature 34 in the motor housing interior 5 of the motor housing 2 and the armature 34, in turn, rotates the air discharge conduits 22 in a circular path at the lower armature end 34*b* of the armature 34. Simultaneously, centrifugal force which is generated by the rotating motion of the air discharge conduits 22 pulls air 24 from the air discharge conduits 22 through the respective terminal discharge openings 22*b* thereof and disperses the air 24 in a circular and outward trajectory into the surrounding liquid medium 29 in the tank 28. The resulting air pressure drop in the air discharge conduits 22 causes ambient air 24 to enter the air inlet conduit 10*a* through the inlet end 21 (FIG. 12) and flow from the air conduit bore 15 through the motor housing neck 6*a*, the air flow space 26, the motor housing interior 5, the armature opening or openings 35 in the armature 34 and the armature cavity 36*a* into the air discharge conduits 22, respectively. The centrifugal force also disperses the air from the air discharge conduits 22 in a circular and outward dispersal path into the liquid medium 29, away from the apparatus 1*a*. The discharged air 24 substantially uniformly aerates and increases the oxygen content of the liquid medium 29 and may additionally facilitate mixing of wastewater as well as promote growth of aerobic organisms which break down organic solids in the wastewater in sewage treatment applications. As was heretofore described with respect to FIG. 2A, in some embodiments the air 24 may additionally be discharged from each air discharge conduit 22 through one or more of the intermediate air discharge openings 23 in one or more of the air discharge conduits 22 to enhance dispersal of the oxygen in the liquid medium 29. It will be appreciated by those skilled in the art that as it traverses the motor housing interior 5 from the air flow space 26 to the armature opening or openings 35 in the armature 34, the air 24 contacts and cools the motor windings 20 of the pump motor 16.

Figure 13:
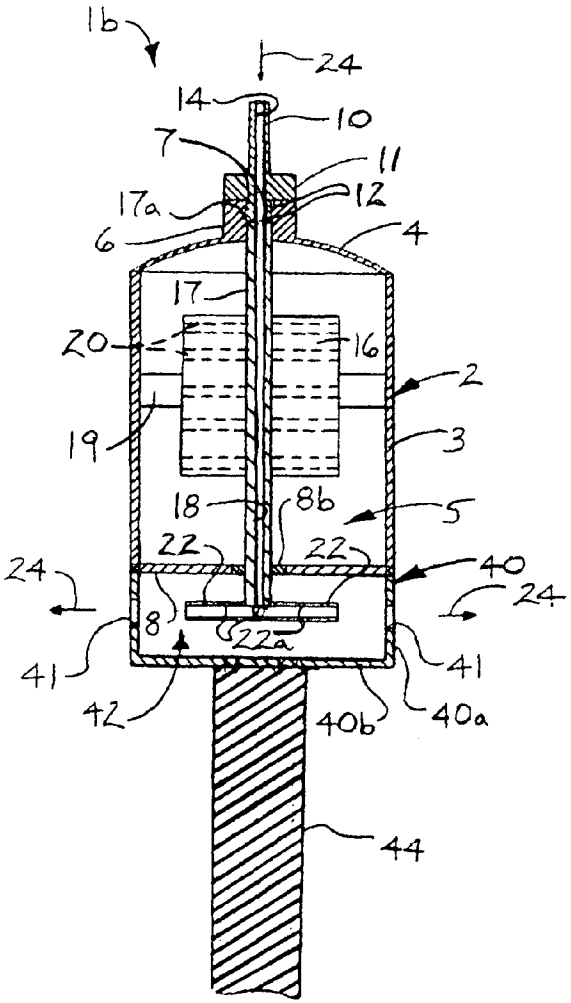
FIG. 13 is a longitudinal sectional view of another alternative illustrative embodiment of the submersible aeration pump.
Figure 15:
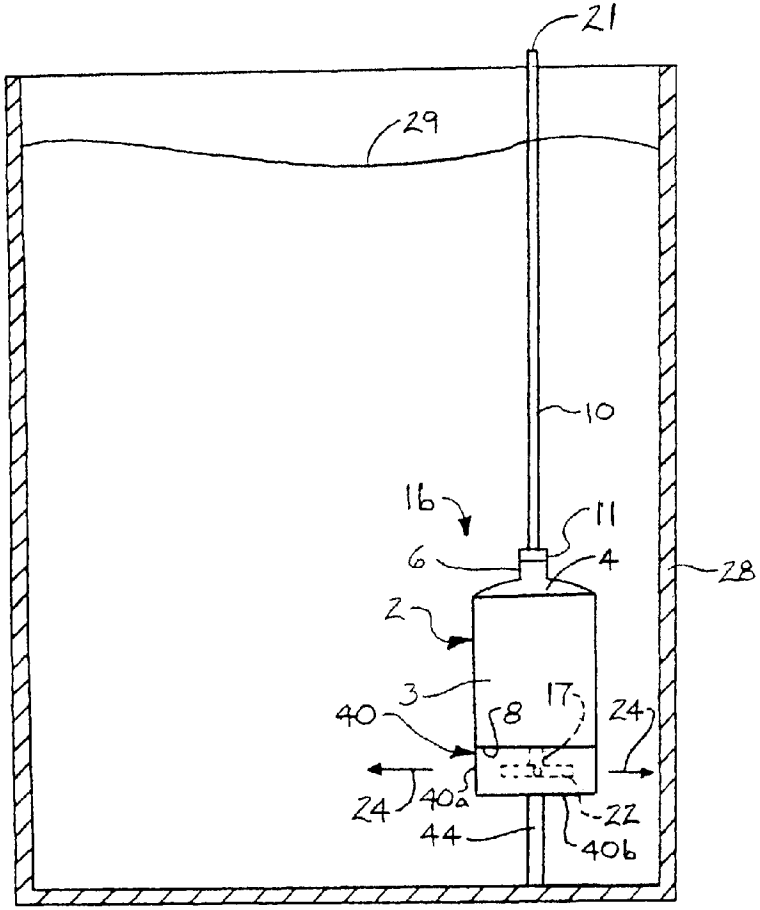
FIG. 15 is a sectional view of a tank containing a liquid medium, with an illustrative embodiment of the submersible aeration pump such as that illustrated in FIG. 13 submerged in the liquid medium and air dispersed into the liquid medium by operation of the submersible aeration pump.

Referring next to FIGS. 13 and 15 of the drawings, another illustrative embodiment of the submersible aeration pump is generally indicated by reference numeral 1*b*. The pump 1*b* may be similar in design to the pump 1 which was heretofore described with respect to FIGS. 1-9. A motor housing extension 40 having a housing extension wall 40*a*, a housing extension bottom 40*b* and an extension interior 42 may extend from the bottom of the motor housing 2. The air discharge conduits 22 on the armature 17 may be disposed inside the extension interior 42. The motor housing extension 40 may be liquid-permeable. In some embodiments, at least one air opening 41 may extend through the housing extension wall 40*a*. In other embodiments, the housing extension wall 40*a* may include a liquid-permeable screen material. When the pump 1*b* is mounted in the tank 28 (FIG. 15), the housing extension bottom 40*b* of the motor housing extension 40 may be supported on the upper end of an pump support post 44.

As illustrated in FIG. 15, in exemplary application of the pump 1*b*, the pump support post 44 supports the pump 1*b*, submerged in the liquid medium 29, above the bottom of the tank 28. The liquid medium 29 enters the extension interior 42 (FIG. 13) of the motor housing extension 40 through the air openings 41 or alternatively, through the porous screen material in the housing extension wall 40*a*. Operation of the pump 1*b* may be as was heretofore described with respect to the pump 1 in FIGS. 1-9. Accordingly, centrifugal force which is generated by rotation of the air discharge conduits 22 in the extension interior 42 of the motor housing extension 40 pulls air 24 through the air conduit bore 14 (FIG. 13) of the air inlet conduit 10 and the armature bore 18 of the armature 17 and through the discharge conduit bores 22*a* and from the terminal discharge openings 22*b* of the respective air discharge conduits 22 into the extension interior 42 of the motor housing extension 40. The air 24 flows from the extension interior 42 of the motor housing extension 40 and is dispersed by centrifugal force into the surrounding liquid medium 29 in the tank 28 through the air openings 41 in the housing extension wall 40*a* of the motor housing extension 40 or alternatively, through the screen material in the housing extension wall 40*a*.

Figure 14:
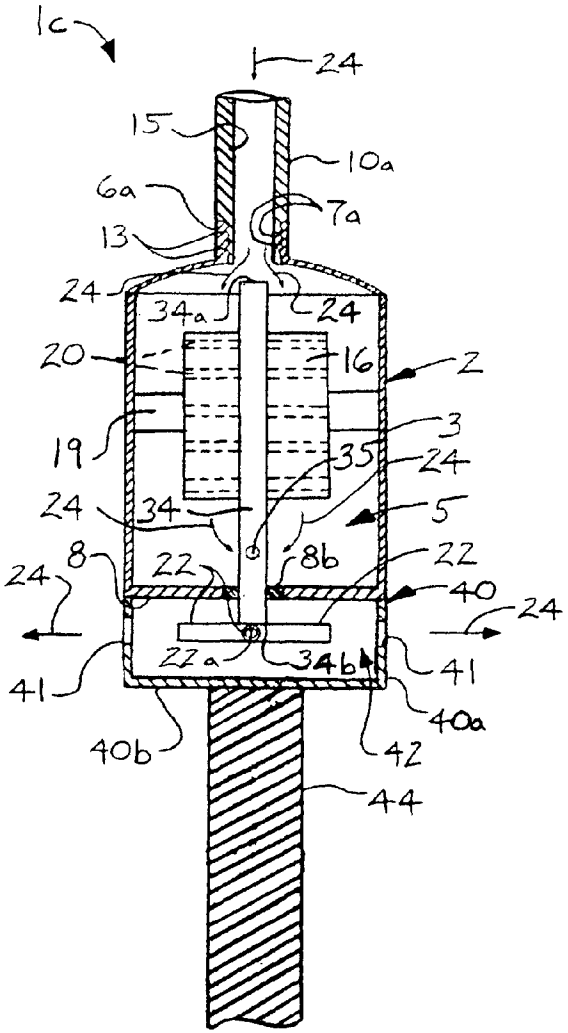
FIG. 14 is a longitudinal sectional view of still another alternative illustrative embodiment of the submersible aeration pump.

Referring next to FIG. 14 of the drawings, another illustrative embodiment of the submersible aeration pump is generally indicated by reference numeral 1*c*. The pump 1*c* may be similar in design to the pump 1*a* which was heretofore described with respect to FIG. 10. A motor housing extension 40 having a housing extension wall 40*a*, a housing extension bottom 40*b* and an extension interior 42 may extend from the bottom of the motor housing 2 with the air discharge conduits 22 on the armature 34 disposed inside the extension interior 42. In some embodiments, at least one air opening 41 may extend through the housing extension wall 40*a*. In other embodiments, the housing extension wall 40*a* may include a liquid-permeable screen material. A pump support post 44 may support the housing extension bottom 40*b* of the motor housing extension 40 above the bottom of a tank 28 (FIG. 15) when the pump 1*c* is submerged in a liquid medium 29 in the tank 28. The liquid medium 29 enters the extension interior 42 of the motor housing extension 40 through the air openings 41 or alternatively, through the porous screen material in the housing extension wall 40*a*.

In application of the pump 1*c*, ambient air 24 flows first through the air conduit bore 15 (FIG. 14) of the air inlet conduit 10*a* and then through the motor housing neck 6*a* and the air flow space 26 (FIG. 10), respectively, into the motor housing interior 5. The air 24 flows from the motor housing interior 5 through the armature opening or openings 35 and into the armature bore 36 (FIG. 10) of the armature 34 and is discharged from the rotating air discharge conduits 22 into the extension interior 42 of the motor housing extension 40 by centrifugal force. The air 24 is dispersed in a circular and outward trajectory from the extension interior 42 of the motor housing extension 40 and into the surrounding liquid medium 29 in the tank 28 through the air openings 41 or alternatively, through the porous screen material in the housing extension wall 40*a* of the motor housing extension 40. As it flows through the motor housing interior 5, the air 24 contacts and cools the motor windings 20 of the pump motor 16.

Figure 17:
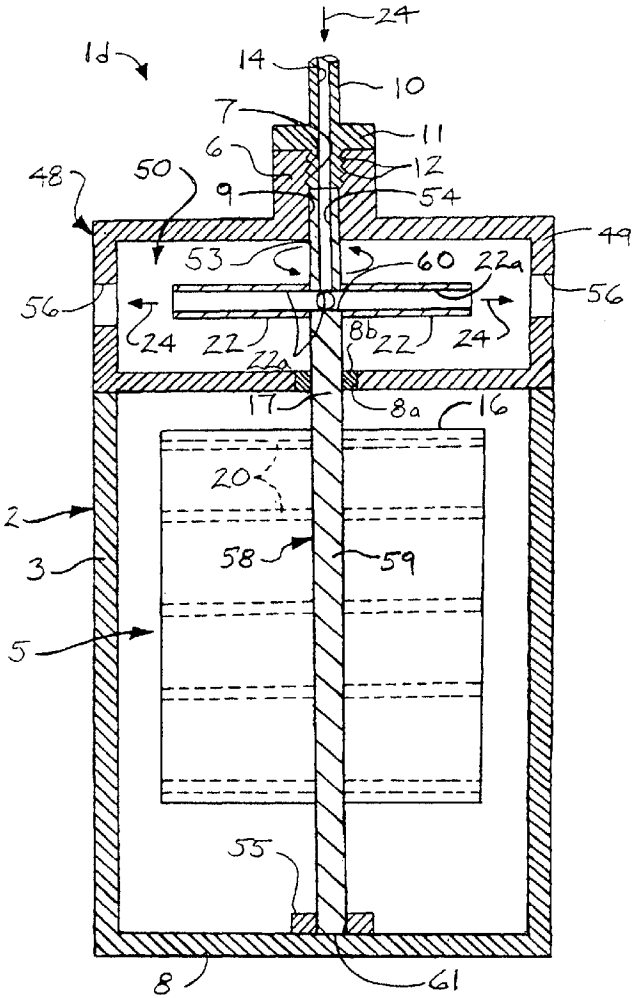
FIG. 17 is a longitudinal sectional view of the illustrative embodiment of the submersible aeration pump illustrated in FIG. 16.
Figure 16:
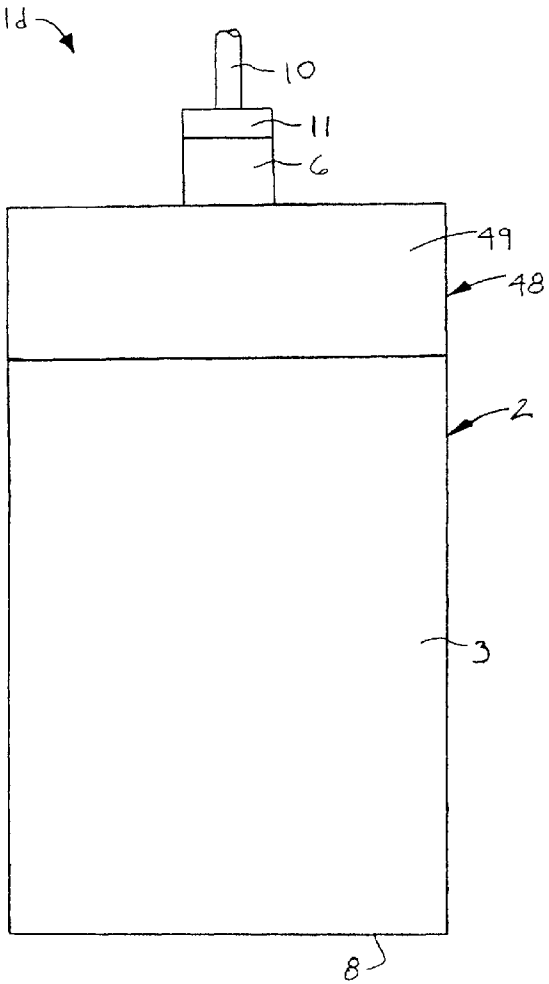
FIG. 16 is a side view of an alternative illustrative embodiment of the submersible aeration pump.

Referring next to FIGS. 16 and 17 of the drawings, still another alternative illustrative embodiment of the submersible aeration pump is generally indicated by reference numeral 1*d*. The pump 1*d* may include a motor housing 2 having a motor housing wall 3 which in some embodiments may be generally cylindrical and a motor housing interior 5 which is defined by the motor housing wall 3. A liquid-permeable housing top 48 may be provided on the motor housing wall 3 of the motor housing 2. The housing top 48 may include a housing top wall 49 which may be generally cylindrical in some embodiments and defines a housing top interior 50. In some embodiments, at least one air opening 56 may extend through the housing top wall 49. In other embodiments, the housing top wall 49 may include a liquid-permeable screen material. A seal 8*b* may be seated in a seal opening 8*a* in the bottom portion of the housing top wall 49 of the housing top 48.

An air inlet conduit 10 having an air conduit bore 14 may be adapted for attachment to the housing top 48. In some embodiments, a motor housing neck 6 may extend from the housing top wall 49 of the housing top 48. The motor housing neck 6 may have an interior motor housing neck bore 9. Interior neck threads 7 may extend into an upper portion of the motor housing neck bore 9 of the motor housing neck 6. A male conduit adaptor 11 may terminate the end of the air inlet conduit 10. The male conduit adaptor 11 may have exterior adaptor threads 12 which engage the interior neck threads 7 in the motor housing neck bore 9 of the motor housing neck 6. Alternative techniques known by those skilled in the art may be used to attach the air inlet conduit 10 to the housing top 48. In some embodiments, the air inlet conduit 10 may be fabricated in one piece with or fixedly attached to the housing top 48 using molding, casting, gluing or other fabrication techniques known by those skilled in the art.

An armature 58 may include a main armature segment 59 having an upper armature segment end 60 and a lower armature segment end 61. An air inlet armature segment 53 of the armature 58 may have an armature bore 54 which is disposed in fluid communication with the air conduit bore 14 of the air inlet conduit 10. The air inlet armature segment 53 may be journaled for rotation in the non-threaded lower portion of the motor housing neck bore 9 of the motor housing neck 6. In some embodiments, a bearing (not illustrated) may be provided in the motor housing neck bore 9 of the motor housing neck 6. The air inlet armature segment 53 may extend through the bearing. At least one air discharge conduit 22 may extend outwardly from the air inlet armature segment 53 into the housing top interior 50 of the housing top 48. In some embodiments, the air discharge conduits 22 may extend outwardly from a lower end of the air inlet armature segment 53, as illustrated in FIG. 17. The air discharge conduits 22 may each have at least one discharge conduit bore 22*a* which is disposed in fluid communication with the armature bore 54 of the air inlet armature segment 53. In some embodiments, at least one air discharge opening 23 (FIG. 2A) may be provided along the length of each air discharge conduit 22.

The main armature segment 59 of the armature 58 in the motor housing interior 5 of the motor housing 2 drivingly engages the air discharge conduits 22 for rotation. In some embodiments, the air discharge conduits 22 may extend outwardly from an upper armature segment end 60 of the main armature segment 59, as illustrated in FIG. 17, between the air inlet armature segment 53 and the main armature segment 59. The main armature segment 59 may extend through the seal 8*b* in the bottom portion of the housing top wall 49. A lower armature segment end 61 of the main armature segment 59 may be seated for rotation in an armature bearing 55 provided on the housing bottom 8 inside the motor housing interior 5. The pump motor 16 drivingly engages the main armature segment 59 for rotation of the armature 58 inside the motor housing 2. Accordingly, responsive to operation of the pump motor 16, the armature 58 rotates the air discharge conduits 22 in the housing top interior 50 of the housing top 48.

In exemplary application, the pump 1*d*, disposed in fluid communication with the air inlet conduit 10, may be submerged in a liquid medium 29 (FIG. 15) inside a tank 28. The liquid medium 29 enters the housing top interior 50 of the submerged housing top 48 through the air opening or openings 56 in the housing top wall 49 of the housing top 48 or alternatively, through the liquid-permeable screen material in the housing top wall 49. As the pump motor 16 rotates the armature 58 and the air discharge conduits 22, centrifugal force generated by the rotating air discharge conduits 22 causes ambient air 24 to flow through the air conduit bore 14 of the air inlet conduit 10, the conduit bore 54 of the air inlet armature segment 53 and the discharge conduit bores 22*a* of the respective air discharge conduits 22. The air 24 is discharged from the air discharge conduits 22 into the surrounding liquid medium 29 in the housing top interior 50 of the housing top 48 in an outward circular trajectory. The oxygenated liquid medium 29 flows from the housing top interior 50 into the tank 28 (FIG. 15) through the air opening or openings 56 in the housing top wall 49 or alternatively, through the liquid-permeable screen material in the housing top wall 49.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A submersible aeration pump, comprising:

a motor housing;

an air inlet conduit carried by said motor housing;

a pump motor in said motor housing;

a rotatable armature drivingly engaged by said pump motor and disposed in air communication with said air inlet conduit;

at least one air discharge conduit carried by and disposed in air communication with said armature; and wherein air is drawn from said air inlet conduit, through at least a portion of said armature and is discharged from said at least one air discharge conduit, respectively, by centrifugal force responsive to operation of said pump motor.

2. The submersible aeration pump of claim 1 wherein said at least one air discharge conduit comprises a discharge conduit bore disposed in air communication with said armature and a terminal discharge opening terminating said discharge conduit bore.

3. The submersible aeration pump of claim 2 further comprising at least one intermediate air discharge opening in said at least one air discharge conduit and communicating with said discharge conduit bore.

4. The submersible aeration pump of claim 1 wherein said at least one air discharge conduit comprises a plurality of air discharge conduits.

5. The submersible aeration pump of claim 1 further comprising a liquid-permeable motor housing extension having an extension interior carried by said motor housing and wherein said at least one air discharge conduit is disposed in said extension housing interior of said motor housing extension.

6. The submersible aeration pump of claim 5 further comprising a housing bottom separating said extension interior of said motor housing extension from said motor housing, a seal opening in said housing bottom and a seal in said seal opening, and wherein said armature extends through said seal.

7. The submersible aeration pump of claim 1 further comprising an armature bore in said armature and disposed in air communication with said air inlet conduit and said at least one air discharge conduit.

8. The submersible aeration pump of claim 1 wherein said at least one air discharge conduit is external to said motor housing.

9. The submersible aeration pump of claim 1 further comprising a liquid-permeable housing top having a housing top interior carried by said motor housing and wherein said at least one air discharge conduit is disposed in said housing top interior.

10. The submersible aeration pump of claim 9 wherein said armature comprises a main armature segment drivingly engaged by said pump motor and an air inlet armature segment disposed in air communication with said air inlet conduit, and wherein said at least one air discharge conduit extends from said armature between said main armature segment and said air inlet armature segment.

11. A submersible aeration pump, comprising:

an air inlet conduit;

a motor housing disposed in air communication with said air inlet conduit;

a pump motor in said motor housing;

a rotatable armature drivingly engaged by said pump motor and having an armature cavity disposed in air communication with said motor housing;

at least one air discharge conduit carried by and disposed in air communication with said armature cavity of said armature; and wherein air is drawn from said air inlet conduit, through said motor housing and said armature cavity of said armature and is discharged from said at least one air discharge conduit, respectively, by centrifugal force responsive to operation of said pump motor.

12. The submersible aeration pump of claim 11 further comprising a motor housing neck on said motor housing and communicating with said motor housing interior and wherein said air inlet conduit is coupled to said motor housing neck.

13. The submersible aeration pump of claim 12 further comprising an air flow space generally between said motor housing neck and said armature and establishing air communication between said air conduit and said motor housing.

14. The submersible aeration pump of claim 11 wherein said at least one air discharge conduit is external to said motor housing.

15. The submersible aeration pump of claim 11 further comprising a liquid-permeable motor housing extension having an extension interior carried by said motor housing and wherein said at least one air discharge conduit is disposed in said extension housing interior of said motor housing extension.

16. The submersible aeration pump of claim 15 further comprising at least one air opening in said motor housing extension.

17. The submersible aeration pump of claim 15 further comprising a housing bottom separating said extension interior of said motor housing extension from said motor housing, a seal opening in said housing bottom and a seal in said seal opening, and wherein said armature extends through said seal.

18. A submersible aeration pump, comprising:

a motor housing;

an air inlet conduit carried by said motor housing;

a pump motor in said motor housing;

a rotatable armature drivingly engaged by said pump motor and having an armature bore disposed in air communication with said air inlet conduit;

at least one air discharge conduit carried by and disposed in air communication with said armature bore of said armature; and wherein air is drawn from said air inlet conduit, through said armature bore of said armature and is discharged from said at least one air discharge conduit, respectively, by centrifugal force responsive to operation of said pump motor.

19. The submersible aeration pump of claim 18 wherein said at least one air discharge conduit comprises a discharge conduit bore disposed in air communication with said air conduit bore of said air inlet conduit and a terminal discharge opening terminating said discharge conduit bore.

20. The submersible aeration pump of claim 19 further comprising at least one intermediate air discharge opening in said at least one air discharge conduit and communicating with said discharge conduit bore.

21. The submersible aeration pump of claim 19 further comprising a liquid-permeable motor housing extension having an extension interior carried by said motor housing and wherein said at least one air discharge conduit is disposed in said extension housing interior of said motor housing extension.

22. The submersible aeration pump of claim 21 further comprising a housing bottom separating said extension interior of said motor housing extension from said motor housing, a seal opening in said housing bottom and a seal in said seal opening, and wherein said armature extends through said seal.

* * * * *